US011613926B2

(12) United States Patent
Dahlgren et al.

(10) Patent No.: US 11,613,926 B2
(45) Date of Patent: Mar. 28, 2023

(54) COUNTERBALANCING SPRING FASTENERS

(71) Applicant: Crestron Electronics, Inc., Rockleigh, NJ (US)

(72) Inventors: Bruce Ryan Dahlgren, Jackson Heights, NY (US); Michael Campagna, Woodcliff Lake, NJ (US)

(73) Assignee: Crestron Electronics, Inc., Rockleigh, NJ (US)

( * ) Notice: Subject to any disclaimer, the term of this patent is extended or adjusted under 35 U.S.C. 154(b) by 531 days.

(21) Appl. No.: 16/855,694

(22) Filed: Apr. 22, 2020

(65) Prior Publication Data

US 2020/0248505 A1 Aug. 6, 2020

Related U.S. Application Data

(63) Continuation-in-part of application No. 15/872,467, filed on Jan. 16, 2018, now Pat. No. 10,738,530.

(51) Int. Cl.

| | |
|---|---|
| ***E06B 9/62*** | (2006.01) |
| ***E06B 9/42*** | (2006.01) |
| ***E06B 9/72*** | (2006.01) |
| ***E06B 9/60*** | (2006.01) |

(52) U.S. Cl.

CPC ..... *E06B 9/42* (2013.01); *E06B 9/60* (2013.01); *E06B 9/62* (2013.01); *E06B 9/72* (2013.01)

(58) Field of Classification Search

CPC ..... E06B 9/62; E06B 9/60; E06B 9/56; E06B 9/42; F16F 1/12; F16F 1/122

See application file for complete search history.

(56) References Cited

U.S. PATENT DOCUMENTS

| | | | | | |
|---|---|---|---|---|---|
| 654,893 | A * | 7/1900 | Hatshorn | E06B 9/60 | 267/155 |
| 1,994,142 | A * | 3/1935 | Madsen | E05D 15/24 | 16/104 |
| 6,155,327 | A * | 12/2000 | Wells | E06B 9/60 | 160/198 |
| 6,988,527 | B2 * | 1/2006 | Savard | E05D 13/1261 | 49/199 |
| 2014/0352898 | A1 * | 12/2014 | Veatch | E06B 9/62 | 29/525.01 |
| 2018/0252034 | A1 * | 9/2018 | Lin | B60J 1/2033 | |

FOREIGN PATENT DOCUMENTS

| | | | | |
|---|---|---|---|---|
| EP | 141454 A * | 5/1985 | E06B 9/60 | |
| EP | 729856 A1 * | 9/1996 | B60J 5/125 | |
| WO | WO-2020011861 A1 * | 1/2020 | E06B 9/60 | |

* cited by examiner

*Primary Examiner* — Marcus Menezes
*Assistant Examiner* — Jeremy C Ramsey
(74) *Attorney, Agent, or Firm* — Crestron Electronics, Inc.

(57) ABSTRACT

A roller shade comprising a roller tube, a shade material attached to the roller tube, and a shade drive unit adapted to rotate the roller tube to lower or raise the shade material. The shade drive unit comprises a spring adapted to counterbalance the shade drive unit, a spring carrier, and a spring fastener. The spring carrier comprises a cylindrical barrel, wherein one of the first and second ends of the spring is concentrically positioned over the cylindrical barrel of the spring carrier. The spring fastener comprising a body having a curved bottom surface adapted to be positioned over one of the first and second ends of the spring and attached to the cylindrical barrel of the spring carrier.

18 Claims, 6 Drawing Sheets

COUNTERBALANCING SPRING FASTENERS

BACKGROUND OF THE INVENTION

Technical Field

Aspects of the embodiments generally relate to roller shades, and more particularly to systems, methods, and modes for the attachment of a counterbalancing spring to a shade drive unit of the roller shade.

Background Art

Motorized roller shades provide a convenient one-touch control solution for screening windows, doors, or the like, to achieve privacy and thermal effects. A motorized roller shade typically includes a rectangular shade material attached at one end to a cylindrical rotating tube, called a roller tube, and at an opposite end to a hem bar. The shade material is wrapped around the roller tube. An electric motor, either mounted inside the roller tube or externally coupled to the roller tube, rotates the roller tube to unravel the shade material to cover a window. To uncover the window, however, a lot of torque and motor power are required to initially lift the entire weight of the shade material and the hem bar. This is in particular detrimental to battery operated motors as rolling up the shade quickly drains the battery.

Various methods exist for counterbalancing roller shades using pretensioned springs mounted inside the roller tubes in an effort to reduce torque requirements on shade motors. As the roller shade is unraveled, tension builds up in the spring. The tension is released when the roller shade is rolled up, thereby assisting the motor in lifting the shade material. One approach uses a conventional torsion spring comprising a plurality of coils. As a torsion spring is wound up, it builds up torque. When the torsion spring is let go, the amount of torque exerted by the torsion spring progressively reduces in a linear fashion as the torsion spring winds down.

Conventionally, a torsion spring is attached to an assembly by bending each end of the spring in a hooked or twisted configuration. In shading systems this approach limits the ability to match the spring rate of each spring to rate of torque that is required for a particular shade. Also, the bent ends of the spring typically require a larger footprint to accommodate, which is lacking in shading system. In shading systems, torsion springs are typically attached by tight fitting the spring on spring carriers that comprise helical grooves that retain the spring coils. However, such systems limit the wire diameter that can be accommodated by the spring carriers—requiring different carriers for differently sized shades.

Therefore, a need has arisen for systems, methods, and modes for the attachment of a counterbalancing spring to a shade drive unit of the roller shade.

SUMMARY OF THE INVENTION

It is an object of the embodiments to substantially solve at least the problems and/or disadvantages discussed above, and to provide at least one or more of the advantages described below.

It is therefore a general aspect of the embodiments to provide systems, methods, and modes for the attachment of a counterbalancing spring to a shade drive unit of the roller shade.

It is also an aspect of the embodiments to provide systems, methods, and modes for a motor pretensioned roller shade that can be pretensioned using the motor to a preset amount and which locks and maintains the pretension.

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter.

Further features and advantages of the aspects of the embodiments, as well as the structure and operation of the various embodiments, are described in detail below with reference to the accompanying drawings. It is noted that the aspects of the embodiments are not limited to the specific embodiments described herein. Such embodiments are presented herein for illustrative purposes only. Additional embodiments will be apparent to persons skilled in the relevant art(s) based on the teachings contained herein.

DISCLOSURE OF INVENTION

According to one aspect of the embodiments, a roller shade is provided comprising a roller tube, a shade material attached to the roller tube, and a shade drive unit adapted to rotate the roller tube to lower or raise the shade material. The shade drive unit comprises: a spring longitudinally extending from a first end to a second end, wherein the spring is adapted to counterbalance the shade drive unit to reduce torque required by the shade drive unit to rotate the roller tube; a spring carrier comprising a cylindrical barrel, wherein one of the first and second ends of the spring is concentrically positioned over the cylindrical barrel of the spring carrier; and a spring fastener comprising a body having a curved bottom surface adapted to be positioned over one of the first and second ends of the spring and attached to the cylindrical barrel of the spring carrier.

According to an embodiment, the cylindrical barrel of the spring carrier comprises a smooth outer surface. According to an embodiment, the spring comprises a torsion spring.

According to an embodiment, the shade drive unit is at least partially disposed within the roller tube, and wherein the shade drive unit further comprises: a motor; a motor housing adapted to house the motor therein; an output mandrel operably connected to the motor, wherein the spring is mounted over the output mandrel; and a drive wheel connected to the roller tube and operably connected to the output mandrel; wherein one of the motor housing and the drive wheel comprises the spring carrier. According to an embodiment, the spring carrier comprises a first spring carrier, wherein the other one of the motor housing and the drive wheel comprises a second spring carrier with substantially the same configuration as the first spring carrier. According to an embodiment, the output mandrel extends from a first end located within the motor housing, out of an opening in the motor housing, and to a second end located outside the motor housing and connected to the drive wheel, wherein the spring is stretched by the first and second spring carriers. The drive wheel may be attached to the second end of the output mandrel using a washer. According to an embodiment, during operation of the motor, rotation of the output mandrel by the motor causes rotation of the drive wheel and thereby the roller tube, while the motor and the motor housing remain stationary as the roller tube rotates about the motor housing.

According to an embodiment, the curved bottom surface of the spring fastener body comprises a radius substantially equal to a radius of the cylindrical barrel of the spring carrier. According to another embodiment, the curved bottom surface of the spring fastener body is adapted to apply clamping pressure on the spring. According to an embodiment, the cylindrical barrel of the spring carrier comprises a threaded hole, wherein the spring fastener comprises a through hole that extends transversely through the spring fastener body, wherein the spring fastener is attached to the barrel by a screw adapted to be inserted through the through hole, between a pair of coils in the spring, and into the threaded hole in the spring carrier barrel. According to an embodiment, the spring carrier barrel comprises a hole, wherein the spring fastener comprises a post laterally extending from the bottom surface of the spring fastener body, wherein when the spring fastener is attached to the spring carrier, the post extends between a pair of coils in the spring and into the hole in the spring carrier barrel. According to an embodiment, the post is adapted to support tensile forces created by the shade drive unit. According to another embodiment, the post is adapted to split the pair of coils of the spring during installation of the spring onto the spring carrier and attachment of the spring fastener. Such a post may comprise a chamfered end. According to another embodiment, the spring fastener comprises an abutment laterally extending from the bottom surface of the spring fastener body, wherein the abutment abuts the spring carrier barrel such that the bottom surface of the spring fastener body is disposed at a distance from the spring carrier barrel.

According to another embodiment, the spring carrier barrel comprises a center threaded hole and a pair of side holes disposed at opposite sides of the center hole, wherein the spring fastener comprises a center through hole that extends transversely through the spring fastener body and a pair of posts on opposite sides of the center through hole that laterally extend from the bottom surface of the spring fastener body, wherein the spring fastener is adapted to be attached to the spring carrier barrel by splitting a pair of coils in the spring using the pair of posts, inserting the pair of posts between the pair of coils and into the pair of holes in the spring carrier barrel, and securing a screw through the center through hole in the spring fastener and to the center threaded hole in the spring carrier barrel. According to yet another embodiment, the spring carrier barrel comprises a center threaded hole, wherein the spring fastener comprises a center through hole that extends transversely through the spring fastener body and a pair of abutments on opposite sides of the center through hole that laterally extend from the bottom surface of the spring fastener body, wherein the spring fastener is adapted to be attached to the spring carrier barrel by a screw adapted to be inserted through the through hole, between a pair of coils in the spring and into the threaded hole in the spring carrier barrel until the pair of abutments abut the spring carrier barrel such that the bottom surface of the spring fastener body is disposed at a distance from the spring carrier barrel.

According to another aspect of the present embodiments, a roller shade is provided comprising a roller tube, a shade material attached to the roller tube, and a shade drive unit adapted to rotate the roller tube to lower or raise the shade material. The shade drive unit comprises: a spring longitudinally extending from a first end to a second end, wherein the spring is adapted to counterbalance the shade drive unit to reduce torque required by the shade drive unit to rotate the roller tube; a spring carrier comprising a cylindrical barrel including a center threaded hole and a pair of side holes disposed at opposite sides of the center hole, wherein one of the first and second ends of the spring is adapted to be concentrically positioned over the spring carrier barrel; and a spring fastener comprising a body, a center through hole that extends transversely through the spring fastener body, a pair of abutments on opposite sides of the center through hole that laterally extend from the bottom surface of the spring fastener body, and a pair of posts on opposite sides of the center through hole that laterally extend from the bottom surface of the spring fastener body; wherein spring fastener is adapted to be attached to the spring carrier barrel by splitting a pair of coils in the spring using the pair of posts, inserting the pair of posts between the pair of coils and into the pair of holes in the spring carrier barrel, and securing a screw through the center through hole in the spring fastener and to the center threaded hole in the spring carrier barrel until the pair of abutments abut the spring carrier barrel such that the bottom surface of the spring fastener body is disposed at a distance from the spring carrier barrel.

According to yet another aspect of the present embodiments, a roller shade is provided comprising a roller tube, a shade material attached to the roller tube, and a shade drive unit adapted to rotate the roller tube to lower or raise the shade material. The shade drive unit comprises a motor; a motor housing adapted to house the motor therein, wherein the motor housing comprises a first spring carrier; a spring longitudinally extending from a first end to a second end, wherein the spring is adapted to counterbalance the shade drive unit to reduce torque required by the shade drive unit to rotate the roller tube; an output mandrel operably connected to the motor and that extends out of the motor housing, wherein the spring is mounted over the output mandrel; a drive wheel operably connected to the output mandrel, wherein the drive wheel comprises a second spring carrier; and a pair of spring fasteners each comprising a body having a curved bottom surface; wherein each of the first and second spring carriers comprises a cylindrical barrel having a smooth outer surface, wherein each of the first and second ends of the spring are concentrically positioned over one of the spring carrier barrels, wherein the spring fastener body of each of the spring fasteners is adapted to be positioned over one of the first and second ends of the spring and attached to one of the spring carrier barrels.

BRIEF DESCRIPTION OF THE DRAWINGS

The above and other objects and features of the embodiments will become apparent and more readily appreciated from the following description of the embodiments with reference to the following figures. Different aspects of the embodiments are illustrated in reference figures of the drawings. It is intended that the embodiments and figures disclosed herein are to be considered to be illustrative rather than limiting. The components in the drawings are not necessarily drawn to scale, emphasis instead being placed upon clearly illustrating the principles of the aspects of the embodiments. In the drawings, like reference numerals designate corresponding parts throughout the several views.

BRIEF DESCRIPTION OF THE SEVERAL VIEWS OF THE DRAWING

Figure 1:
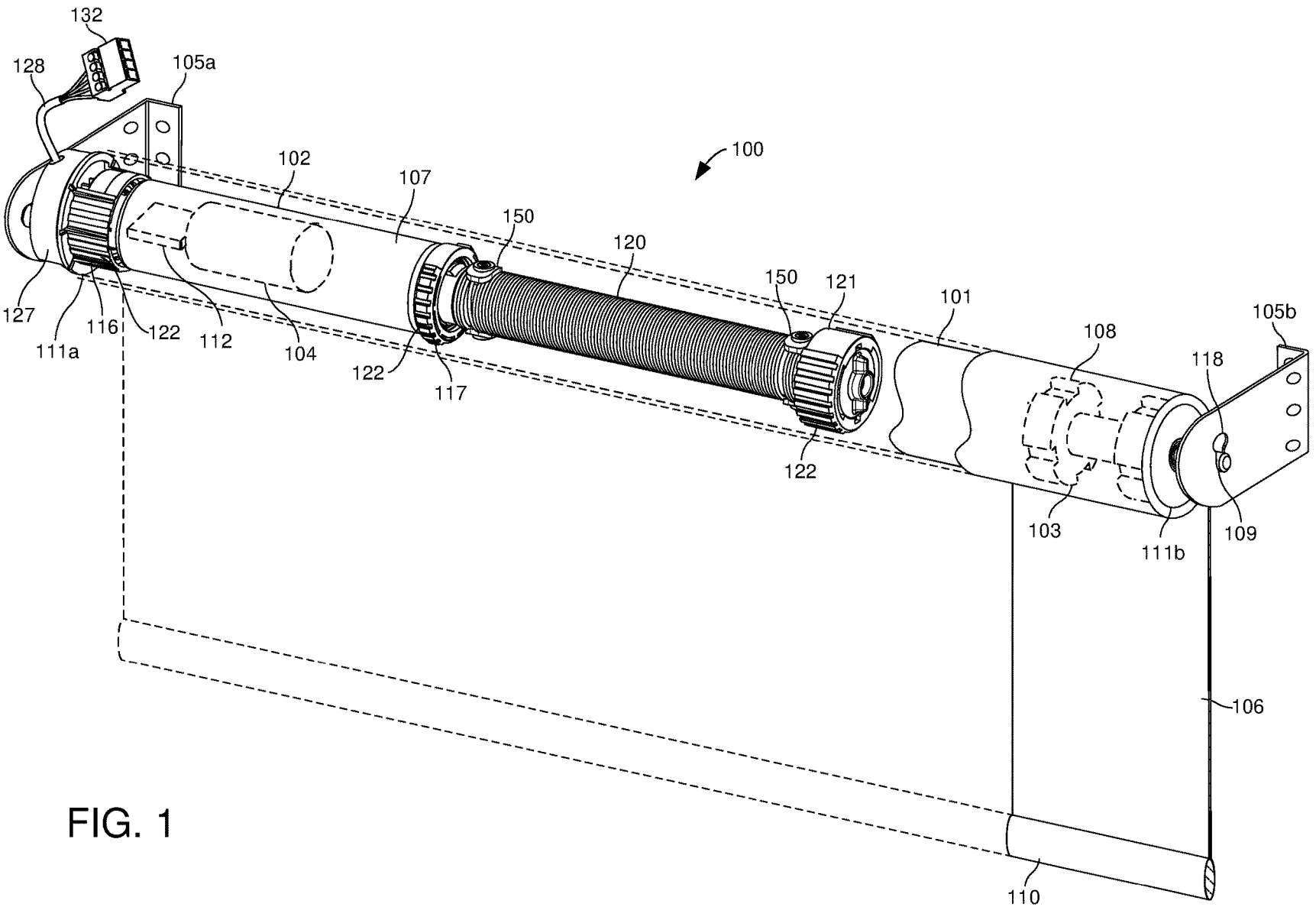

FIG. 1 illustrates a perspective view of a roller shade according to one aspect of the embodiments.

Figure 2:
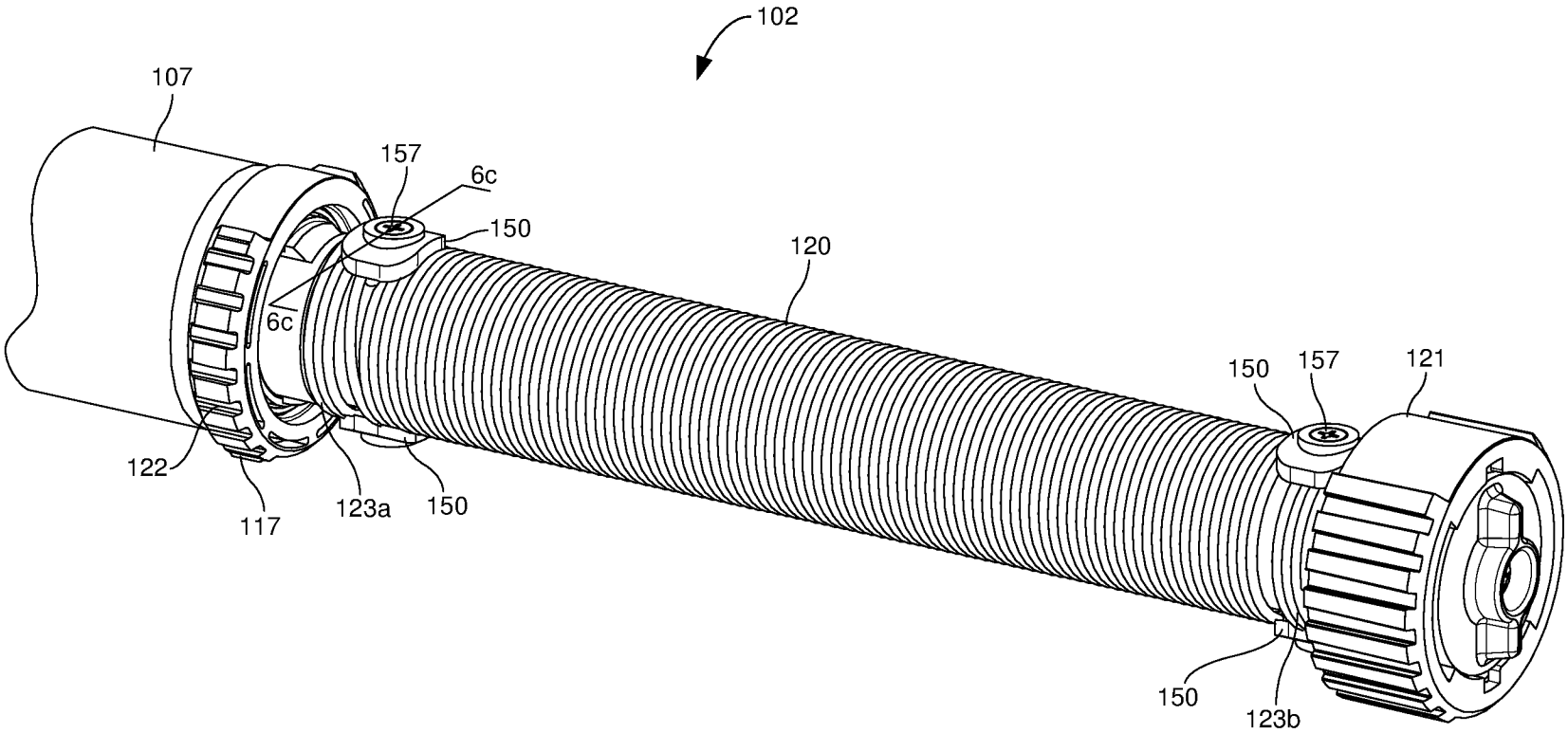

FIG. 2 shows a perspective view of a portion of the shade drive unit according to one aspect of the embodiments.

Figure 3:
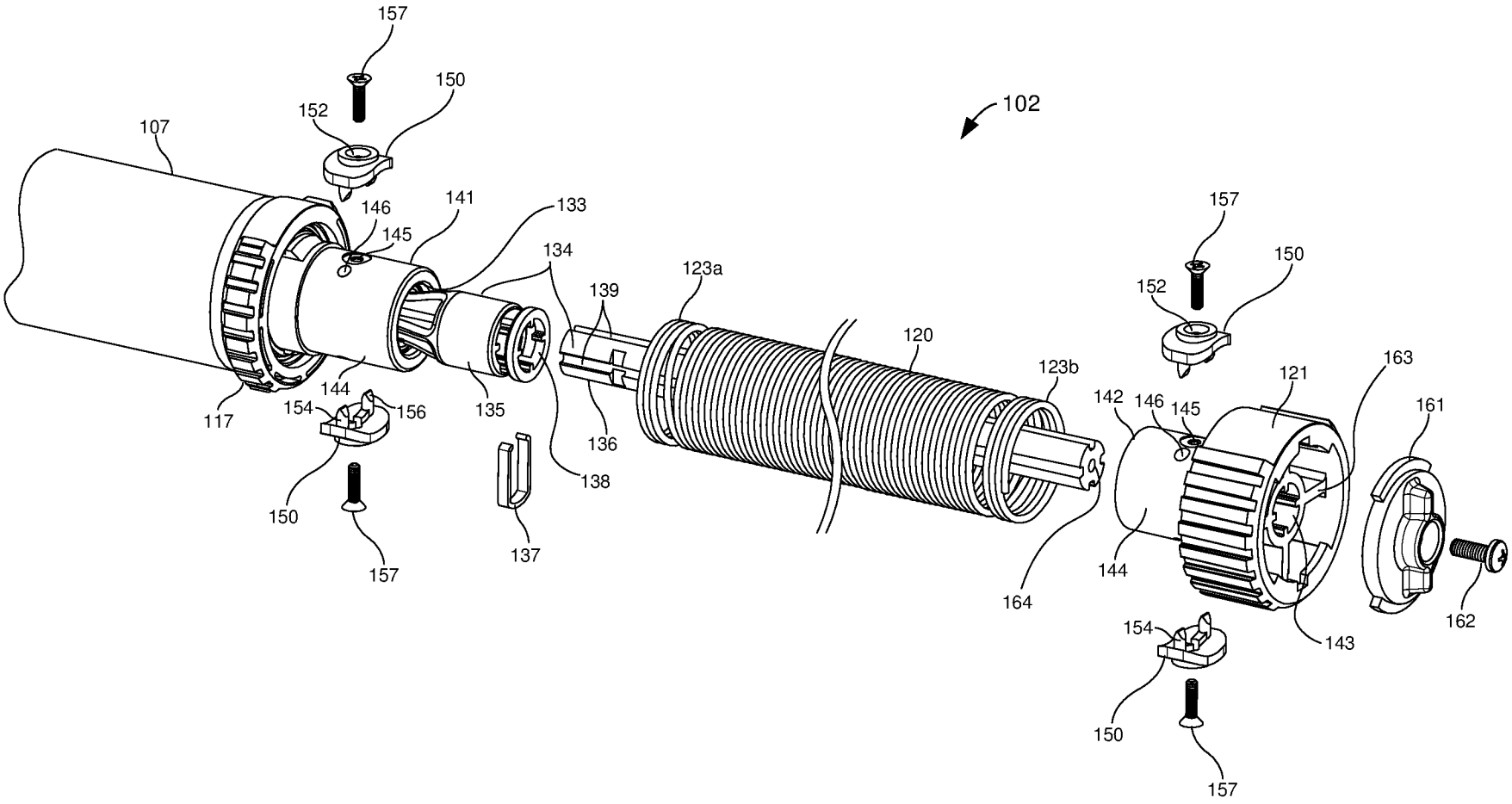

FIG. 3 shows an exploded perspective view of a portion of the shade drive unit according to one aspect of the embodiments.

Figure 4:
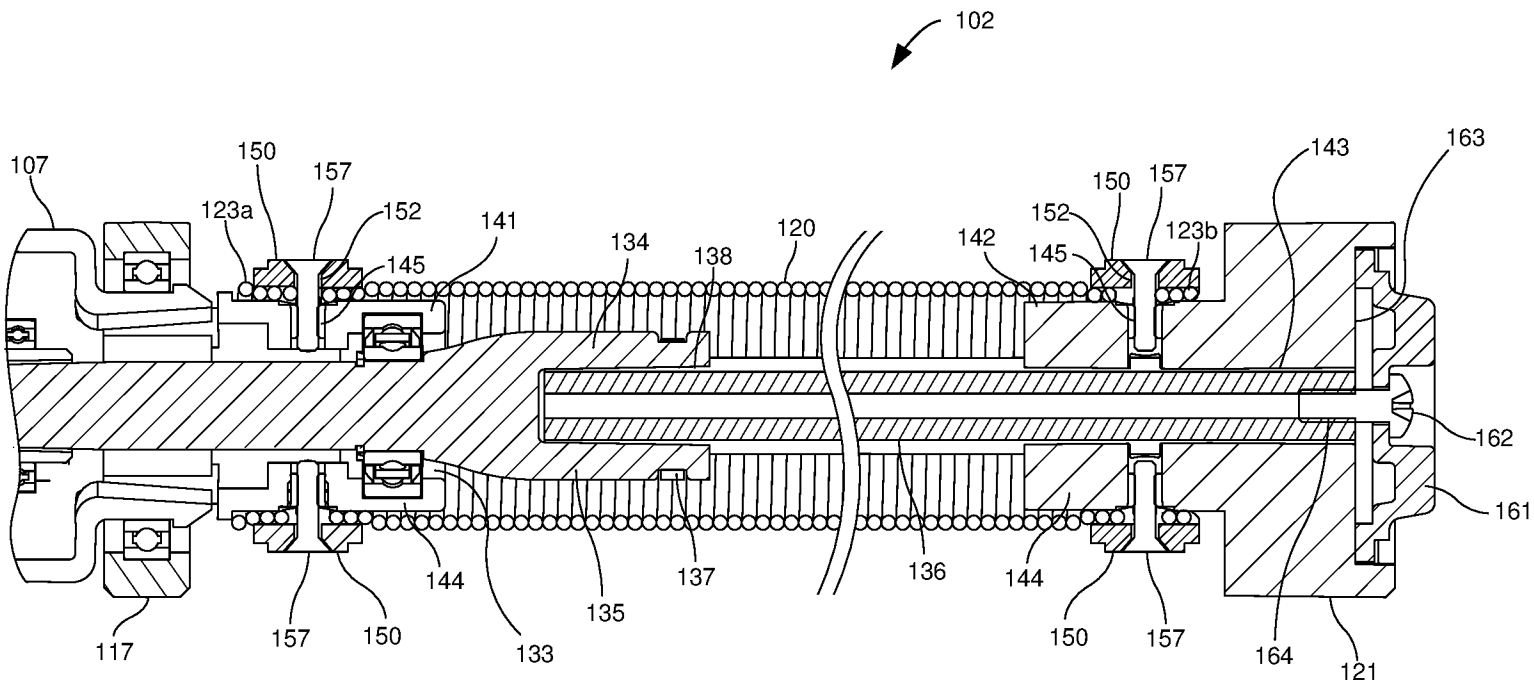

FIG. 4 shows a cross-sectional view of a portion of the shade drive unit according to one aspect of the embodiments.

Figure 5A:
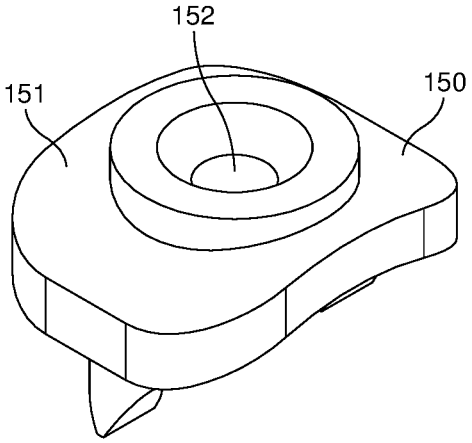

FIG. 5A shows a top perspective view of a spring fastener according to one aspect of the embodiments.

Figure 5B:
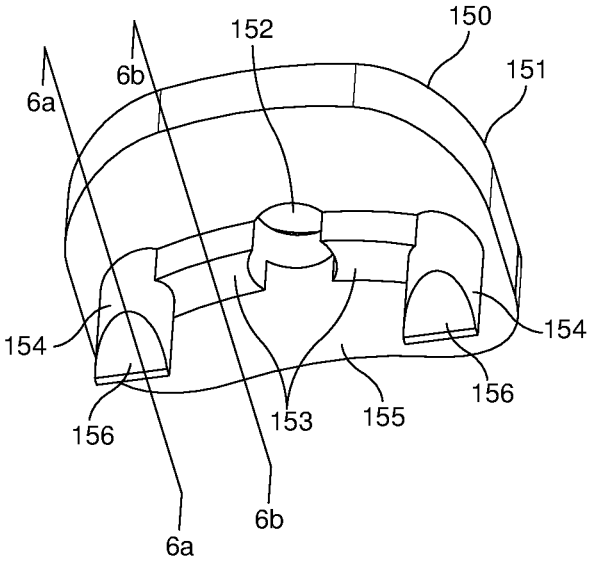

FIG. 5B shows a bottom perspective view of the spring fastener according to one aspect of the embodiments.

Figure 5C:
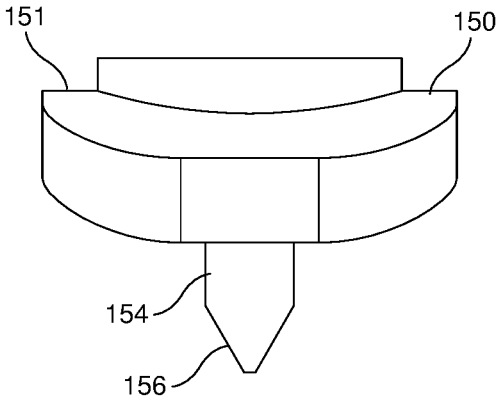

FIG. 5C shows a side view of the spring fastener according to one aspect of the embodiments.

Figure 5D:
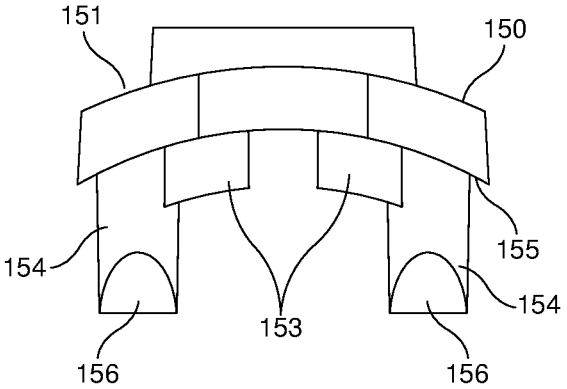

FIG. 5D shows a front view of the spring fastener according to one aspect of the embodiments.

Figure 6A:
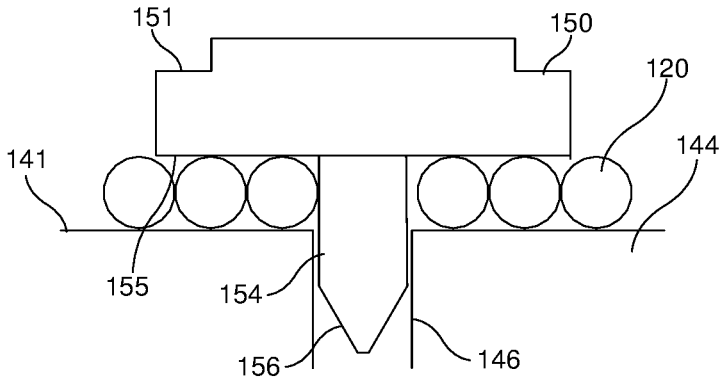

FIG. 6A shows a cross-sectional view of the spring fastener taken across line 6*a* in FIG. 5B attached to a spring carrier according to one aspect of the embodiments.

Figure 6B:
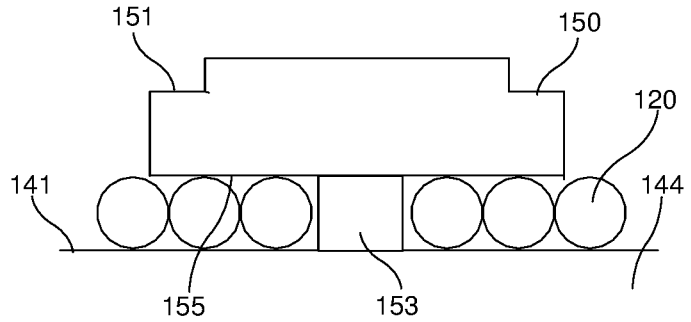

FIG. 6B shows a cross-sectional view of the spring fastener taken across line 6*b* in FIG. 5B attached to a spring carrier according to one aspect of the embodiments.

Figure 6C:
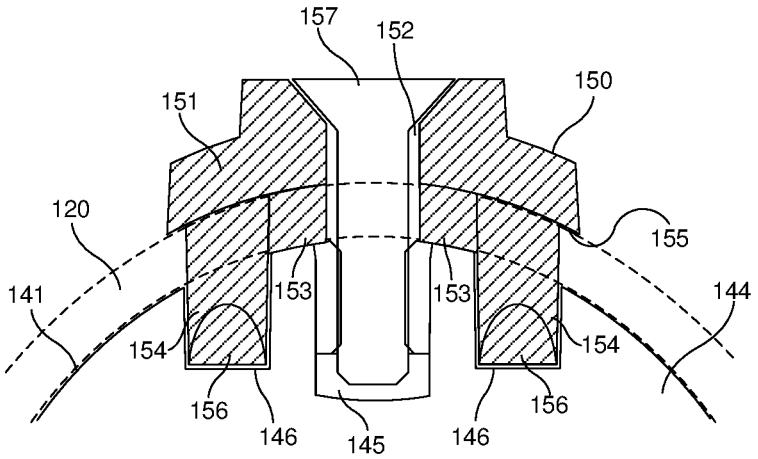

FIG. 6C shows a cross-sectional view of the spring fastener attached to the spring carrier taken across line 6*c* in FIG. 2 according to one aspect of the embodiments.

DETAILED DESCRIPTION OF THE INVENTION

The embodiments are described more fully hereinafter with reference to the accompanying drawings, in which embodiments of the inventive concept are shown. In the drawings, the size and relative sizes of layers and regions may be exaggerated for clarity. Like numbers refer to like elements throughout. The embodiments may, however, be embodied in many different forms and should not be construed as limited to the embodiments set forth herein. Rather, these embodiments are provided so that this disclosure will be thorough and complete, and will fully convey the scope of the inventive concept to those skilled in the art. The scope of the embodiments is therefore defined by the appended claims.

Reference throughout the specification to "one embodiment" or "an embodiment" means that a particular feature, structure, or characteristic described in connection with an embodiment is included in at least one embodiment of the embodiments. Thus, the appearance of the phrases "in one embodiment" or "in an embodiment" in various places throughout the specification is not necessarily referring to the same embodiment. Further, the particular features, structures, or characteristics may be combined in any suitable manner in one or more embodiments.

LIST OF REFERENCE NUMBERS FOR THE ELEMENTS IN THE DRAWINGS IN NUMERICAL ORDER

The following is a list of the major elements in the drawings in numerical order.

100 Roller Shade
101 Roller Tube
102 Shade Drive Unit
103 Idler Assembly
104 Motor
105*a* Mounting Bracket
105*b* Mounting Bracket
106 Shade Material
107 Motor Housing
108 Idler Body
109 Idler Pin
110 Hem Bar
111*a* First End of Roller Tube
111*b* Second End of Roller Tube
112 Motor Control Module
116 Crown Adapter Wheel
117 Idler Crown Wheel
118 Keyhole
120 Counterbalancing Spring
121 Drive Wheel
122 Channels
123*a* First End of Counterbalancing Spring
123*b* Second End of Counterbalancing Spring
127 Motor Head
128 Power Cord
132 Terminal Block
133 Motor Housing Opening
134 Output Mandrel
135 First Mandrel Portion
136 Second Mandrel Portion
137 Retaining Clip
138 Bore
139 Grooves
141 First Spring Carrier
142 Second Spring Carrier
143 Bore
144 Cylindrical Barrel
145 Center Hole
146 Side Holes
150 Spring Fasteners
151 Body
152 Through Hole
153 Abutments
154 Posts
155 Curved Bottom Surface
156 Chamfered Ends
157 Screw
161 Washer
162 Screw
163 End Surface
164 Hole
6*a* Cross-Section Line
6*b* Cross-Section Line
6*c* Cross-Section Line

MODE(S) FOR CARRYING OUT THE INVENTION

For 40 years Crestron Electronics, Inc. has been the world's leading manufacturer of advanced control and automation systems, innovating technology to simplify and enhance modern lifestyles and businesses. Crestron designs, manufactures, and offers for sale integrated solutions to control audio, video, computer, and environmental systems. In addition, the devices and systems offered by Crestron streamlines technology, improving the quality of life in commercial buildings, universities, hotels, hospitals, and homes, among other locations. Accordingly, the systems, methods, and modes of the aspects of the embodiments described herein can be manufactured by Crestron Electronics, Inc., located in Rockleigh, N.J.

The different aspects of the embodiments described herein pertain to the context of attachment of a counterbalancing spring to a shade drive unit of the roller shade, but is not limited thereto, except as may be set forth expressly in the appended claims. While the roller shade is described herein for covering a window, the roller shade may be used to cover doors, wall openings, or the like. The embodiments described herein may further be adapted in other types of window or door coverings, such as inverted rollers, Roman shades, Austrian shades, pleated shades, blinds, shutters, skylight shades, garage doors, or the like. In addition, the counterbalancing spring fasteners of the present embodiments can be used in shade drive units that comprise a motor to drive the roller shade, as described herein, or they can be implemented in non-motorized window treatments without departing from the scope of the present embodiments.

Referring to FIG. 1, there is shown a perspective view of a roller shade 100 according to one aspect of the embodiments. Roller shade 100 generally comprises a roller tube 101, a shade drive unit 102, an idler assembly 103, shade material 106, and a hem bar 110. Shade material 106 is connected at its top end to the roller tube 101 and at its bottom end to the hem bar 110. Shade material 106 wraps around the roller tube 101 and is unraveled from the roller tube 101 to cover a window, a door, a wall opening, or the like. In various embodiments, the shade material 106 comprises fabric, plastic, vinyl, or other materials known to those skilled in the art.

Roller tube 101 is generally cylindrical in shape and longitudinally extends from a first end 111*a* to a second end 111*b*. In various embodiments, the roller tube 101 comprises aluminum, stainless steel, plastic, fiberglass, or other materials known to those skilled in the art. The first end 111*a* of the roller tube 101 receives the shade drive unit 102, and the second end 111*b* of the roller tube 101 receives the idler assembly 103.

The idler assembly 103 of the roller shade 100 may comprise an idler pin 109 and an idler body 108 inserted into the second end 111*b* of the roller tube 101. The idler body 108 may be rotatably connected about the idler pin 109. It is inserted into the roller tube 101 and is operably connected to the roller tube 101 such that rotation of the roller tube 101 also rotates the idler body 108. The idler body 108 may comprise ball bearings therein (not shown) allowing the idler body 108, and thereby the roller tube 101, rotate with respect to the idler pin 109.

During installation, the roller shade 100 is mounted on or in a window between the first and second mounting brackets 105*a* and 105*b*. The roller shade 100 may first be mounted to the second mounting bracket 105*b* by inserting the terminal end of the idler pin 109 into a keyhole 118 in the second mounting bracket 105*b*. The roller shade 100 may then be mounted to the first mounting bracket 105*a* by snapping the motor head 127 of the shade drive unit 102 to the first mounting bracket 105*a* or coupling the shade drive unit 102 to the first mounting bracket 105*a* using screws. The mounting brackets 105*a* and 105*b* can comprise similar configuration to the CSS-DECOR3 QMT® 3 Series Décor Shade Hardware, available from Crestron Electronics, Inc. of Rockleigh, N.J. Other types of brackets may be utilized without departing from the scope of the present embodiments.

The shade drive unit 102 may comprise a motor head 127, a crown adapter wheel 116, a motor housing 107 containing a motor control module 112 and motor 104 therein, an idler crown wheel 117, a counterbalancing spring 120, and a drive wheel 121. The shade drive unit 102 may be inserted into the first end 111*a* of the roller tube 101. The crown adapter wheel 116, idle crown wheel 117, and drive wheel 121 are generally cylindrical in shape and are inserted into and operably connected to roller tube 101 through its first end 111*a*. Crown adapter wheel 116, idle wheel 117, and drive wheel 121 may comprise a plurality of channels 122 extending circumferentially about their external surfaces. Channels 122 mate with complementary projections radially extending from an inner surface of roller tube 101 such that crown adapter wheel 116, idle crown wheel 117, drive wheel 121, and roller tube 101 rotate together during operation. The drive wheel 121 is operably connected to the motor output shaft of the motor 104 such that rotation of the motor output shaft also rotates the drive wheel 121. The crown adapter wheel 116 may be rotatably attached to a first end of the motor housing 107 and the idle wheel 117 may be rotatably attached to a second end of the motor housing 107 via ball bearings therein (not shown). This ensures that the motor 104 is held concentric to the roller tube 101 at the front and the rear of the motor housing 107 by the crown adapter wheel 116 and the idle wheel 117.

The motor control module 112 and the motor 104 are housed within motor housing 107. According to an embodiment, the motor 104 may drive the drive wheel 121 through a series of drive train components that in combination provide efficiency to the roller shade 100, including one or more planetary gears and a clutch, which are described in more detail in U.S. patent application Ser. No. 15/872,467, filed on Jan. 16, 2018, and titled "Motor Pretensioned Rolle Shade", the entire contents of which are hereby incorporated by reference. In operation, the roller shade 100 is rolled down and rolled up via the shade drive unit 102. Particularly, the motor 104 drives the drive wheel 121, which in turn engages and rotates the roller tube 101. The roller tube 101, in turn, engages and rotates the crown adapter wheel 116, idle crown wheel 117, and idler body 108 with respect to the motor 104, while the motor housing 107, including the motor 104 and motor control module 112, remain stationary. As a result, the shade material 106 may be lowered from an opened or rolled up position, when substantially the entire shade material 106 is wrapped about the roller tube 101, to a closed or rolled down position, when the shade material 106 is substantially unraveled, and vice versa.

The motor control module 112 operates to control the motor 104, directing the operation of the motor, including its direction, speed, and position. The motor control module 112 may comprise fully integrated electronics and may include a controller, a memory, a wired or wireless communication interface, a user interface, a light indicator, as well as other electronics. Power may be provided to the motor through a power cord 128 by connecting a terminal block 132 to a dedicated power supply, such as the CSA-PWS40 or CSA-PWS10S-HUB-ENET power supplies, available from Crestron Electronics, Inc. of Rockleigh, N.J. In another embodiment, the shade drive unit 102 may be battery operated and as such may be connected to an internal or external power supply in a form of batteries. In yet another embodiment, the shade drive unit 102 may be powered via solar panels placed in proximity to the window to aggregate solar energy.

Control commands received by the motor control module 112 may be a direct user input from a local user interface or a wired or wireless signal from an external control point. For example, the motor control module 112 may receive a control command from a wall-mounted button panel or a touch-panel in response to a button actuation or similar action by the user. Control commands may also originate from a signal generator such as a timer or a sensor. Accordingly, the motor control module 112 can integrate seamlessly with other control systems using the communication interface to be operated from keypads, wireless remotes, touch screens, and wireless communication devices, such as smart phones. Additionally, the motor control module 112 can be integrated within a large scale building automation system or a small scale home automation system and be controllable by a central control processor, such as the PRO3 control processor available from Crestron Electronics, Inc., that networks, manages, and controls a building management system.

The counterbalancing spring 120 is used to counterbalance the roller shade 100 and assist in lifting the shade material 106 and hem bar 110 throughout the rolling up cycle of the roller shade 100. As a result, the resulting torque required to be exerted by the motor 104 to roll up the shade material 106 is minimal and substantially steady throughout the rolling up cycle of the roller shade 100. Similarly, the resulting power is significantly reduced and is substantially steady throughout the rolling up cycle of the roller shade 100. To efficiently counterbalance the roller shade 100, a proper counterbalancing spring 120 must be determined based on the roller shade properties. The roller shade properties include one or more of the diameter and radius of the roller tube 101, the diameter and radius of the shade material 106 when it is fully wrapped on the roller tube 101, the thickness of the shade material 106, the width and length of the shade material 106, the number of layers of the shade material 106 about the roller tube 101 when it is fully wrapped on the roller tube 101, the weight of the shade material 106, and the weight of the hem bar 110. All of the above customized properties will drive the weight of the roller shade, and thereby the torque required to lift the shade material 106. As such, depending on the window size and the fabric selection, the parameters of the required counterbalancing spring 120 will change. For customizable roller shades, for example, initially a customer will measure the window dimensions and select the style of the roller shade they want. The customer may pick from a selection of mounting brackets and hardware, hem bars, fabric designs, fabric attributes, such as transparency, translucency, and blackout materials, and the like. A customer may use the Crestron® Design Tool, a one-stop Web-based platform for all the Crestron® Shading Solutions designing, available from Crestron Electronics, Inc. of Rockleigh, N.J. Then, the customer will submit their order to the manufacturer. The manufacturer may use computer software to convert the customer requirements to manufacturing specifications for production. The manufacturing specifications specify, for example, the diameter and length of the roller tube 101, the width and length of the shade material 106, the required wire diameter of the spring 120, the required coil diameter of the spring 120, the required length of the spring 120 based on the number of coils required, as well as the sizes and specification of other components to use in assembling the customized roller shade, including the type of hem bar 110.

During assembly, an appropriate counterbalancing spring 120 is chosen and cut based on the manufacturing specifications. According to an embodiment, spring 120 may comprise a torsion spring. However, other types of springs may be used without departing from the scope of current embodiments. A factory may maintain an inventory of springs with various spring wire diameters and/or coil diameters. The present embodiments provide for systems, methods, and modes for the attachment of the counterbalancing spring 120 to the shade drive unit 102 of the roller shade 100. The spring attachment system described herein enables counterbalancing springs to be stocked at a generic length and cut to the optimized length per shade configuration such that the spring comprises a predetermined number of coils determined based on the shade configuration. After being cut, the spring 120 can be directly installed without being further manipulated—i.e., without bending the ends of the spring 120.

Referring to FIGS. 2-4, where FIG. 2 shows a perspective view of a portion of the shade drive unit 102, FIG. 3 shows an exploded perspective view of a portion of the shade drive unit 102, and FIG. 4 shows a cross-sectional view of a portion of the shade drive unit 102, according to one aspect of the embodiments. As discussed above, the motor 104 drives an output mandrel 134 through drive train components described above. The output mandrel 134 extends out of an opening 133 in the motor housing 107 and connects to the drive wheel 121 at its terminal end. According to one embodiment, output mandrel 134 may comprise a single body. Yet according to another embodiment, the output mandrel 134 may comprise a first mandrel portion 135 and a second mandrel portion 136. During manufacturing, the shade drive unit 102 can be stocked with only the first mandrel portion 135 extending out of the motor housing 107 through opening 133. After determining the manufacturing specification, the second mandrel portion 136 may be cut to size to accommodate the length of the required spring 120. The first mandrel portion 135 can comprise a keyed bore 138 while the second mandrel portion 136 can comprise an extrusion with keyed grooves 139 configured to mate with the keyed bore 138 of the first mandrel portion 135. The second mandrel portion 136 can be inserted into the keyed bore 138 of the first mandrel portion 135 and be secured using a retaining clip 137 such that rotation of the first mandrel portion 135 by the motor 104 also rotates the second mandrel portion 136.

The selected and cut spring 120 can then be mounted about the output mandrel 134, which holds and stabilizes the spring 120 within the roller tube 101—preventing the spring 120 from sagging within the roller tube 101. The counterbalancing spring 120 longitudinally extends from a first end 123*a* to a second end 123*b*. Motor housing 107 may comprise a first spring carrier 141 configured for engaging and retaining the first end 123*b* of the spring 120. On the opposite end, drive wheel 121 may comprise a second spring carrier 142 configured for engaging and retaining the second end 123*b* of the spring 120. Each spring carrier 141/142 comprises a cylindrical barrel 144 with a smooth outer surface. This allows the spring carriers 141 and 142 to accommodate a spring 120 with any sized spring wire diameter as well as a spring of any direction of the spring coils—including a left or a right spring coil direction.

Each spring end 123*a*-*b* is adapted to be positioned concentrically over the cylindrical barrel 144 of a respective spring carrier 141 and 142, respectively. According to the aspects of the present embodiments, each spring end 123*a*-*b* is retained over the respective spring carrier barrel 144 using spring fasteners 150. Referring to FIGS. 5A-5D, there are shown different views of the spring fasteners 150, particularly, FIG. 5A shows a top perspective view of a spring fastener 150, FIG. 5B shows a bottom perspective view of the spring fastener 150, FIG. 5C shows a side view of the spring fastener 150, and FIG. 5D shows a front view of the spring fastener 150. Each spring fastener 150 comprises a body 151 that comprises a curved bottom surface 155, which complements the curved contour of the cylindrical barrel of the spring carriers 141 and 142. The spring fastener 150 comprises a through hole 152 that extends transversely through body 151. The spring fastener 150 further comprises a pair of abutments 153 laterally extending from the bottom surface 155 of body 151 on opposite sides of the through hole 152. In addition, the spring fastener 150 comprises a pair of posts 154 laterally extending from the bottom surface 155 of body 151 on opposite sides of the abutments 153 to a further distance than the pair of abutments 153. Each post 154 may comprise a chamfered end 156.

Referring back to FIGS. 2-4, during assembly of the roller shade 100 to customer specifications, initially the first end 123*a* of the spring 120 is mounted about the cylindrical barrel 144 of the first spring carrier 141. The cylindrical barrel 144 of each spring carrier 142/142 comprises a center threaded hole 146 and a pair of side holes 146 disposed at opposite sides of the center hole 146. The spring 120 may be cut with additional number of coils that are required to properly counterbalance the roller shade 100 which are used to attach the spring 120 to the spring carriers 141/142. After counting a predetermined number of additional coils at the first end 123*a*, a spring fastener 150 may be pushed between the spring coils to split the coils of the spring 120 apart by inserting its posts 154 between the spring coils as illustrated in FIG. 6A. FIG. 6A shows a cross-sectional view of the spring fastener 150 taken across line 6*a* in FIG. 5B attached to a spring carrier 141. The chamfered ends 156 of the posts 154 of the spring fastener 150 assist to split the spring coils apart. The posts 154 of the spring fastener 150 are then inserted through the side holes 146 in the cylindrical barrel 144 of the first spring carrier 141 as illustrated in FIGS. 6A and 6C. FIG. 6C shows a cross-sectional view of the spring fastener 150 attached to the spring carrier 141 taken across line 6*c* in FIG. 2. The spring fastener 150 is then secured to the first spring carrier 141 using a screw 157. The screw 157 is inserted through hole 152 in the spring fastener 150, between the split coils in the spring 120, and threadably secured to the threaded center hole 145 until the abutments 153 abut the outer surface of the cylindrical barrel 144 of the first spring carrier 141. According to alternative embodiments, instead of a screw 157, the spring fastener 150 can be attached to the spring carrier barrel 144 using other attachment implementations, such as a push clip, an anchor, or the like. As shown in FIG. 6C as well as FIG. 6B, which shows a cross-sectional view of the spring fastener 150 taken across line 6*b* in FIG. 5B attached to the spring carrier 141, the abutments 153 keep the bottom surface 155 of the spring fastener 150 at a distance from the outer surface of the cylindrical barrel 144 of the first spring carrier 141. As illustrated in FIG. 6C, the curved bottom surface 155 of the spring fastener 150 is curved to an optimal radius substantially matching the radius of the cylindrical barrel 144 of the spring carrier 141 to apply a clamping pressure on the spring 120.

Referring back to FIGS. 2-4, after a first spring fastener 150 is attached, a second spring fastener 150 may be attached to an opposite side of the cylindrical barrel 144 of the first spring carrier 141. Then, the second end 123*b* of the spring 120 is attached to the second spring carrier 142 of the drive wheel 121. The drive wheel 121 may comprise a keyed bore 143 adapted to slidably retain the second mandrel portion 136. The second mandrel portion 136 may comprise a shape complementary to the keyed bore 143 such that rotation of the second mandrel portion 136 also rotates the drive wheel 121. As such, rotation of the output shaft of the motor 104 also rotates the drive wheel 121, which in turn rotates the roller tube 101. The drive wheel 121 is mounted over the second mandrel portion 136 by inserting the second mandrel portion 136 through bore 143 until the second end 123*b* of the spring 120 is slid over the cylindrical barrel 144 of the second spring carrier 142. A pair of spring fasteners 150 are then used to secure the second end 123*b* of the spring 120 to the barrel 144 of the second spring carrier 142 in the same manner as discussed above with respect to the first end 123*a* of the spring 120. After attaching the spring 120 to the second spring carrier 142, the drive wheel 121 is pulled to stretch out the spring 120 until the terminal end of the second mandrel portion 136 is fully inside bore 143 and does not extend out of the bore 143 of the drive wheel 121. A washer 161 may then be biased against an end surface 163 of the drive wheel and secured to a threaded hole 164 in the terminal end of the second mandrel portion 136 using a screw 162.

After the shade drive unit 102 is fully assemble, the spring 120 needs to be pretensioned using a preset number of determined pretensioning turns, which is determined during manufacturing using the shade properties discussed above. Using the aforementioned roller shade properties, the number of required pretension turns can be determined, for example using the techniques and formulas disclosed in U.S. patent application Ser. No. 15/872,467, filed on Jan. 16, 2018, and titled "Motor Pretensioned Rolle Shade", the entire contents of which are hereby incorporated by reference. The spring 120 may be pretensioned in either a clockwise or counterclockwise direction, depending on the direction the shade drive unit 102 needs to turn to unravel the shade material 106 from the roller tube 101 and the direction of the spring coils. The spring 120 may be pretensioned using the motor 104 by the desired number of pretensioning turns while the shade drive unit 102 is outside of the roller tube 101. After the pretension, the shade drive unit 102 is inserted into the roller tube 101. The clutch of the drive train prevents any rotational motion back from the drive wheel 121 such that clutch can lock the pretension in the spring 120. After its assembly, the roller shade 100 is shipped out to the customer to be installed in a window.

After installation and during operation, to roll down the roller shade 100, the motor 104 rotates drive wheel 121 and thereby the second spring carrier 142 and roller tube 101 in a first direction, while the motor housing 107 and thereby the first spring carrier 141 remain stationary. Rotation of the motor 104, as well as the increasing weight of the shade material 106 and the hem bar 110, cause the counterbalancing spring 120 to progressively build torque. As a result, the inner coil diameter of the spring 120 contracts and each spring end 123*a* and 123*b* clamps down on the cylindrical barrel 144 of a respective spring carrier 141 and 142, which support the torsional load. The posts 154 of spring fasteners 150 that extend into the side holes 146 in barrel 144 of each spring carrier 141/142 further assist to support tensile forces. On the other hand, when rolling up the shade material 106, the torque that was built up in the counterbalancing spring 120 during the rolling down cycle is progressively released and assists the motor 104 to roll up the shade material 106 during substantially the entire rolling up cycle.

INDUSTRIAL APPLICABILITY

To solve the aforementioned problems, the aspects of the embodiments are directed toward systems, methods, and modes for the attachment of a counterbalancing spring to a shade drive unit of the roller shade. It should be understood that this description is not intended to limit the embodiments. On the contrary, the embodiments are intended to cover alternatives, modifications, and equivalents, which are included in the spirit and scope of the embodiments as defined by the appended claims. Further, in the detailed description of the embodiments, numerous specific details are set forth to provide a comprehensive understanding of the claimed embodiments. However, one skilled in the art would understand that various embodiments may be practiced without such specific details.

Although the features and elements of aspects of the embodiments are described being in particular combinations, each feature or element can be used alone, without the other features and elements of the embodiments, or in various combinations with or without other features and elements disclosed herein.

This written description uses examples of the subject matter disclosed to enable any person skilled in the art to practice the same, including making and using any devices or systems and performing any incorporated methods. The patentable scope of the subject matter is defined by the claims, and may include other examples that occur to those skilled in the art. Such other examples are intended to be within the scope of the claims.

The above-described embodiments are intended to be illustrative in all respects, rather than restrictive, of the embodiments. Thus the embodiments are capable of many variations in detailed implementation that can be derived from the description contained herein by a person skilled in the art. No element, act, or instruction used in the description of the present application should be construed as critical or essential to the embodiments unless explicitly described as such. Also, as used herein, the article "a" is intended to include one or more items.

All United States patents and applications, foreign patents, and publications discussed above are hereby incorporated herein by reference in their entireties.

Alternate Embodiments

Alternate embodiments may be devised without departing from the spirit or the scope of the different aspects of the embodiments. The embodiments described herein may be used for covering windows as well as doors, wall openings, or the like. The embodiments described herein may further be adapted in other types of window or door coverings, such as inverted rollers, Roman shades, Austrian shades, pleated shades, blinds, shutters, skylight shades, garage doors, or the like.

Moreover, the process described herein for determining the number of preset pretensions and for pretensioning the spring is not meant to limit the aspects of the embodiments, or to suggest that the aspects of the embodiments should be implemented following this process. The purpose of the aforementioned process is to facilitate the understanding of one or more aspects of the embodiments and to provide the reader with one or many possible implementations of the processes discussed herein. The steps performed during the pretensioning process are not intended to completely describe the process but only to illustrate some of the aspects discussed above. It should be understood by one of ordinary skill in the art that the steps may be performed in a different order and that some steps may be eliminated or substituted.

The invention claimed is:

1. A roller shade comprising:

a roller tube;

a shade material attached to the roller tube; and a shade drive unit adapted to rotate the roller tube to lower or raise the shade material, wherein the shade drive unit comprises:

a spring longitudinally extending from a first end to a second end, wherein the spring is adapted to counterbalance the shade drive unit to reduce torque required by the shade drive unit to rotate the roller tube;

a spring carrier comprising a cylindrical barrel including a pair of holes, wherein one of the first or second ends of the spring is concentrically positioned over the cylindrical barrel of the spring carrier; and a spring fastener comprising a body having a curved bottom surface adapted to be positioned over one of the first or second ends of the spring and attached to the cylindrical barrel of the spring carrier;

wherein the spring fastener comprises a pair of posts laterally extending from the bottom surface of the spring fastener body, wherein the spring fastener is attached to the spring carrier by splitting a pair of coils in the spring using the pair of posts, inserting the pair of posts between the pair of coils and into the pair of holes in the spring carrier cylindrical barrel, and securing the spring fastener to the spring carrier cylindrical barrel via an attachment member.

2. The roller shade of claim 1, wherein the cylindrical barrel of the spring carrier comprises a smooth outer surface.

3. The roller shade of claim 1, wherein the shade drive unit is at least partially disposed within the roller tube, and wherein the shade drive unit further comprises:

a motor;

a motor housing adapted to house the motor therein;

an output mandrel operably connected to the motor, wherein the spring is mounted over the output mandrel;

a drive wheel connected to the roller tube and operably connected to the output mandrel;

wherein one of the motor housing and the drive wheel comprises the spring carrier.

4. The roller shade of claim 3, wherein the spring carrier comprises a first spring carrier, wherein the other one of the motor housing and the drive wheel comprises a second spring carrier with substantially the same configuration as the first spring carrier.

5. The roller shade of claim 4, wherein the output mandrel extends from a first end located within the motor housing, out of an opening in the motor housing, and to a second end located outside the motor housing and connected to the drive wheel, wherein the spring is stretched by the first and second spring carriers.

6. The roller shade of claim 5, wherein the drive wheel is attached to the second end of the output mandrel using a washer.

7. The roller shade of claim 3, wherein during operation of the motor, rotation of the output mandrel by the motor causes rotation of the drive wheel and thereby the roller tube, while the motor and the motor housing remain stationary as the roller tube rotates about the motor housing.

8. The roller shade of claim 1, wherein the spring comprises a torsion spring.

9. The roller shade of claim 1, wherein the curved bottom surface of the spring fastener body comprises a radius substantially equal to a radius of the cylindrical barrel of the spring carrier.

10. The roller shade of claim 9, wherein the curved bottom surface of the spring fastener body is adapted to apply clamping pressure on the spring.

11. The roller shade of claim 1, wherein the cylindrical barrel of the spring carrier comprises a threaded hole, wherein the spring fastener comprises a through hole that extends transversely through the spring fastener body, wherein the spring fastener is attached to the barrel by a screw adapted to be inserted through the through hole, between the pair of coils in the spring, and into the threaded hole in the spring carrier barrel.

12. The roller shade of claim 1, wherein the pair of posts are adapted to support tensile forces created by the shade drive unit.

13. The roller shade of claim 1, wherein each of the pair of posts comprises a chamfered end.

14. The roller shade of claim 1, wherein the spring fastener comprises an abutment laterally extending from the bottom surface of the spring fastener body, wherein the abutment abuts the spring carrier barrel such that the bottom surface of the spring fastener body is disposed at a distance from the spring carrier barrel.

15. The roller shade of claim 1, wherein the attachment member comprises at least one selected from the group consisting of a screw, a push clip, and an anchor.

16. The roller shade of claim 1, wherein the spring carrier cylindrical barrel comprises a center threaded hole, wherein the spring fastener comprises a center through hole that extends transversely through the spring fastener body and a pair of abutments on opposite sides of the center through hole that laterally extend from the bottom surface of the spring fastener body, wherein the spring fastener is adapted to be attached to the spring carrier barrel by the attachment member, the attachment member comprising a screw adapted to be inserted through the center through hole between the pair of coils in the spring and into the center threaded hole in the spring carrier barrel until the pair of abutments abut the spring carrier barrel such that the bottom surface of the spring fastener body is disposed at a distance from the spring carrier barrel.

17. A roller shade comprising:

a roller tube;

a shade material attached to the roller tube; and a shade drive unit adapted to rotate the roller tube to lower or raise the shade material, wherein the shade drive unit comprises:

a spring longitudinally extending from a first end to a second end, wherein the spring is adapted to counterbalance the shade drive unit to reduce torque required by the shade drive unit to rotate the roller tube;

a spring carrier comprising a cylindrical barrel including a center threaded hole and a pair of side holes disposed at opposite sides of the center hole, wherein one of the first and second ends of the spring is adapted to be concentrically positioned over the spring carrier barrel; and a spring fastener comprising a body, a center through hole that extends transversely through the spring fastener body, a pair of abutments on opposite sides of the center through hole that laterally extend from the bottom surface of the spring fastener body, and a pair of posts on opposite sides of the center through hole that laterally extend from the bottom surface of the spring fastener body;

wherein the spring fastener is adapted to be attached to the spring carrier barrel by splitting a pair of coils in the spring using the pair of posts, inserting the pair of posts between the pair of coils and into the pair of side holes in the spring carrier barrel, and securing a screw through the center through hole in the spring fastener and to the center threaded hole in the spring carrier cylindrical barrel until the pair of abutments abut the spring carrier barrel such that the bottom surface of the spring fastener body is disposed at a distance from the spring carrier cylindrical barrel.

18. A roller shade comprising:

a roller tube;

a shade material attached to the roller tube; and a shade drive unit adapted to rotate the roller tube to lower or raise the shade material, wherein the shade drive unit comprises:

a spring longitudinally extending from a first end to a second end, wherein the spring is adapted to counterbalance the shade drive unit to reduce torque required by the shade drive unit to rotate the roller tube;

a spring carrier comprising a cylindrical barrel including a hole, wherein one of the first and second ends of the spring is concentrically positioned over the cylindrical barrel of the spring carrier; and a spring fastener comprising a body having a curved bottom surface adapted to be positioned over one of the first and second ends of the spring and attached to the cylindrical barrel of the spring carrier, wherein the spring fastener comprises a post laterally extending from the bottom surface of the spring fastener body, wherein the post comprises a chamfered end;

wherein the spring fastener is attached to the barrel by splitting a pair of coils in the spring using the chamfered end of the post, inserting the post between the pair of coils and into the hole in the spring carrier barrel, and securing the spring fastener to the spring carrier barrel via an attachment member.

* * * * *